US006932254B2

(12) United States Patent
Eliason

(10) Patent No.: US 6,932,254 B2
(45) Date of Patent: Aug. 23, 2005

(54) SLING FOR CARRYING OBJECTS

(75) Inventor: Scott Eliason, Monument, CO (US)

(73) Assignee: Eliason Enterprises, Inc., Monument, CO (US)

( * ) Notice: Subject to any disclaimer, the term of this patent is extended or adjusted under 35 U.S.C. 154(b) by 179 days.

(21) Appl. No.: 10/366,016

(22) Filed: Feb. 13, 2003

(65) Prior Publication Data

US 2004/0159687 A1 Aug. 19, 2004

(51) Int. Cl.[7] ..... F41C 23/02; F41C 33/00; A45F 3/14; A45F 3/04; A45F 4/00

(52) U.S. Cl. ..... 224/150; 224/258; 224/260; 224/578; 224/913; 224/916; 224/917; 150/108

(58) Field of Search ..... 224/149, 150, 224/157, 258, 600, 910, 913, 916, 917, 260, 578; 150/108

(56) References Cited

U.S. PATENT DOCUMENTS 1,186,496 A * 6/1916 Randall ..... 224/150
2,357,363 A * 9/1944 Smith et al. ..... 224/150
4,182,469 A * 1/1980 Bennett ..... 224/150
4,768,689 A * 9/1988 Davis ..... 224/257
5,065,732 A * 11/1991 Smith ..... 124/88
5,370,286 A * 12/1994 Newman ..... 224/578
5,450,991 A * 9/1995 Neading ..... 224/578
5,603,545 A * 2/1997 Benson et al. ..... 294/150
5,810,219 A * 9/1998 Rosenfield ..... 224/150
5,950,893 A * 9/1999 Heggeland ..... 224/578
6,068,167 A * 5/2000 Hopson ..... 224/150
6,371,346 B1 * 4/2002 Sharma ..... 224/578
6,581,812 B2 * 6/2003 Roscoe-Dare ..... 224/259

* cited by examiner

*Primary Examiner*—Sue A. Weaver
(74) *Attorney, Agent, or Firm*—Richard W. Hanes; Hanes & Schultz, P.C.

(57) ABSTRACT

The carrying sling of the present invention comprises a length of flexible webbing in the form of a strap being twice folded back on itself to form first, second and third reaches between the first and second ends of the strap. The ends of the strap include apparatus that is adapted to interconnect with or wrap around an object to be carried. Each of the two folds is formed where the strap is trained through first and second slides that are either releasably or permanently connected to the terminal ends of the strap. Providing at least one of the reaches of the strap with means for adjusting its length adds further utility to the carrying strap.

11 Claims, 6 Drawing Sheets

SLING FOR CARRYING OBJECTS

FIELD OF THE INVENTION

The present invention relates to an improved sling to assist a person in carrying objects such as firearms, archery bows, skis, duffle bags and the like.

BACKGROUND OF THE INVENTION

Straps and slings for assisting a person with carrying a rifle and other elongated firearms have been produced for over the shoulder use as long as such devices have existed. Exemplary of more recent developments in the field of rifle or shotgun carrying slings is the U.S. Patent to Bennett for *Sling Device For A Rifle Or The Like*, U.S. Pat. No. 4,182,469 and, more recently, U.S. Pat. No. 5,810,219 to Resenfield for *Gun Sling*. U.S. Pat. No. 5,065,732 to Smith discloses a sling for carrying archery bows. While the objectives of these and other similar patents were to expand the utility of gun and bow slings, the disclosed devises are, by their very nature, confined to long barreled guns and archery bows and even as to those specialized uses the carrying configurations are limited by the constraints of the respective sling constructions.

Accordingly, it is the primary object of the present invention to provide a carrying sling that is readily adaptable to a large number of different configurations that accommodate both a variety of different objects to be carried and many diverse human body loading arrangements.

Another significant objective of the invention is to provide a carrying sling that is easily adaptable to the work of carrying skis, duffle bags and the like, as well as firearms and archery bows.

Other and further objects, features and advantages of the invention will become apparent upon a reading of the following specification, taken together with the accompanying drawings in which.

SUMMARY OF INVENTION

Figure 3:
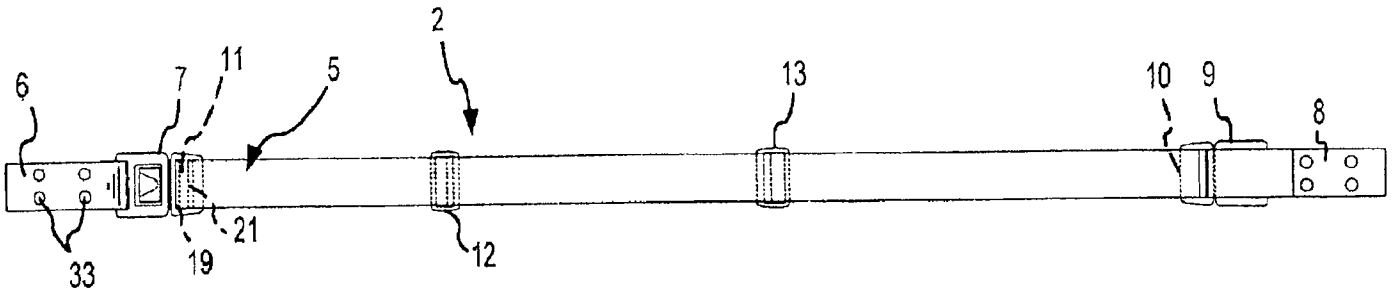
FIG. 3 is a top plan view of the strap shown in FIG. 1.

The multi-purpose carrying sling of the present invention comprises a length of flexible webbing in the form of a strap being twice folded back on itself to form first, second and third reaches between the first and second ends of the strap. The ends of the strap include apparatus that is adapted to interconnect with or wrap around an object to be carried. Each of the two folds is formed where the strap is trained through first and second slides that are either releasably or permanently connected to the terminal ends of the strap. Providing at least one of the reaches of the strap with means for adjusting its length adds further utility to the carrying strap.

In its most complete and preferred form, the flexible webbing, or strap, and the slides through which the strap is trained, form a series of four continuous loops with the third and fourth loops together with a pair of release cams forming the length adjustment loop. Selective release or non-release of the male and female components of one or both of the releasable buckles that form the interconnection between the slides and the terminal ends of the strap, together with selective positioning of the release cams that define the adjustment loop, create a large number of possible permutations of the sling structure that enable the user to choose from a multiplicity of various carrying positions for a variety of loads.

DETAILED DESCRIPTION

Reference is first made to FIGS. 1–4 where the preferred form of the carrying strap 2 is seen to comprise a continuous strip of strap webbing 5, attached near its first terminal end 6 to a first release buckle, generally referred to by reference numeral 7, and attached near its second terminal end 8 to a second terminal release buckle, generally referred to by reference numeral 9. In cooperation with transverse slot openings 19 and 21 in the release buckles 7 and 9 and transverse slot openings in two release cams 12 and 13, the webbing 5 is folded back on itself to form four loops, a, b, c and d.

Figure 6:
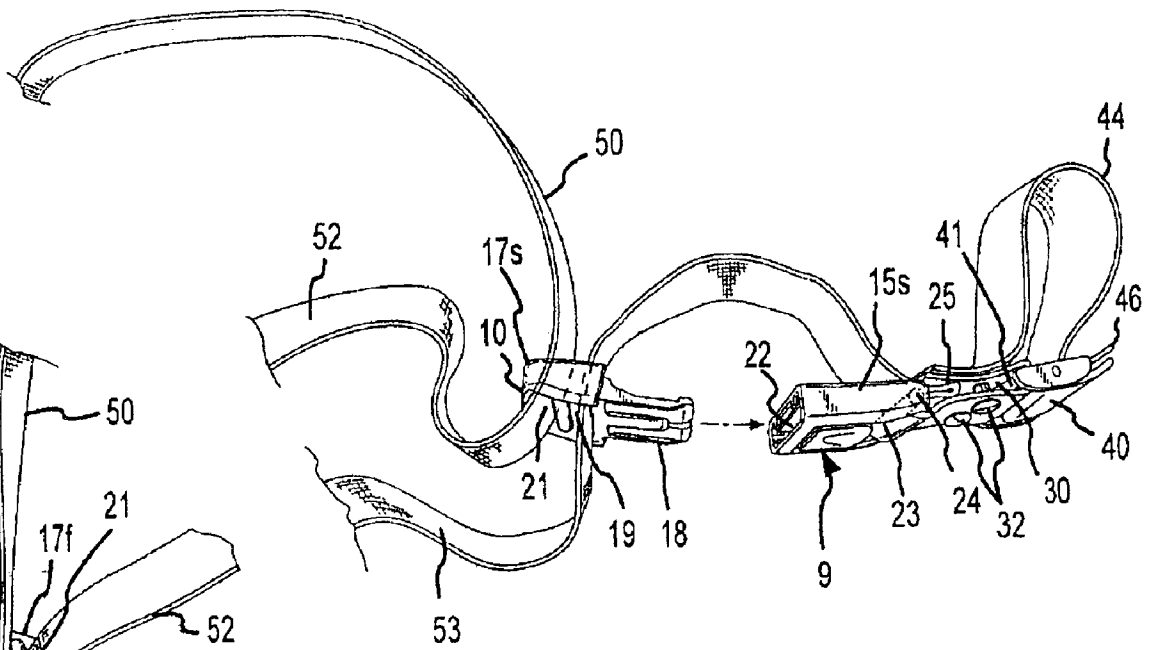
FIG. 6 is an enlarged prospective view of the release buckle and threaded webbing of the second end of the webbing (right hand buckle of FIG. 1). For clarity, the buckle is shown in its released, or unbuckled, position.
Figure 5:
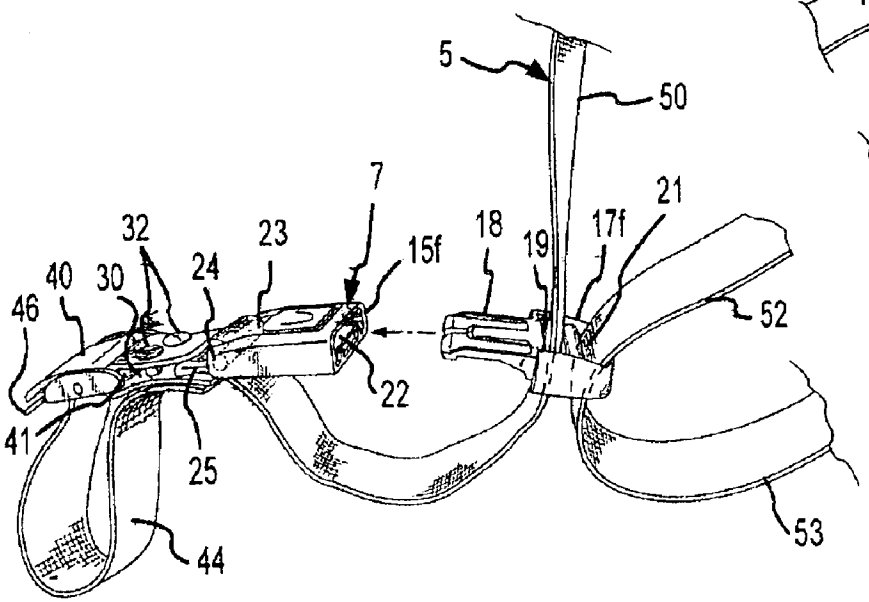
FIG. 5 is an enlarged prospective view of the release buckle and threaded webbing of the first end of the webbing (left hand buckle of FIG. 1). For clarity, the buckle is shown in its released, or unbuckled, position.
Figure 7:
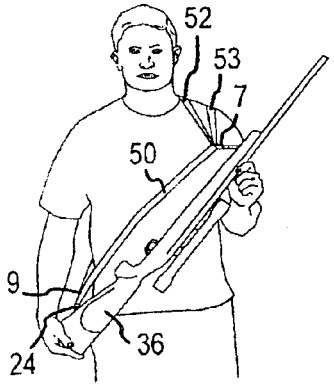
FIGS. 7–17 illustrate exemplary uses of the sling of the present invention by a person wearing the sling, each to be further explained in the detailed description of the invention that follows.
Figure 8:
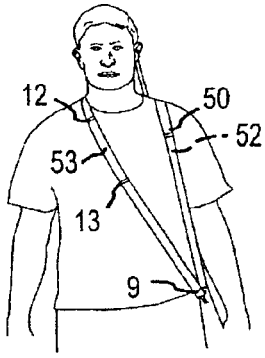
Figure 18:
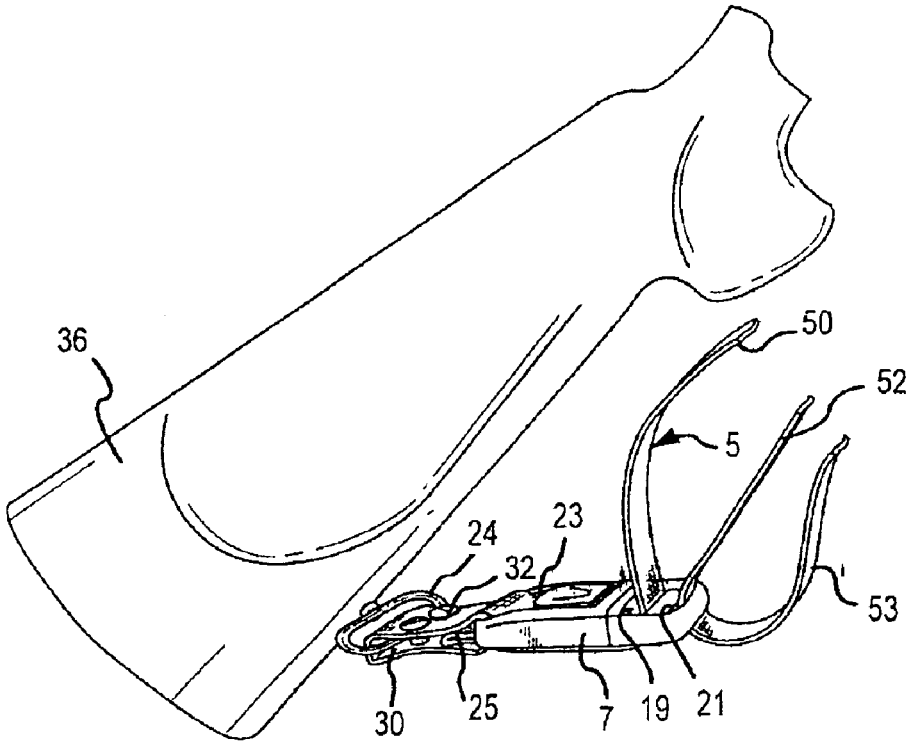
FIG. 18 is a perspective-fragmentary view of a typical connection of one end of the sling to the connecting ring attached to the butt of a rifle.

The release buckles 7 and 9 are illustrated in more detail in FIGS. 5 and 6. Although the buckles are shown as containing a center release, other forms, such as the familiar side release buckle, will serve equally well. Each of the release buckles 7 and 9 comprise male sections 17*f* and 17*s* and female sections 15*f* and 15*s* respectively, the "f" and "s" referring to the first and second ends. Common to each of the buckles, male ends 17 comprise a tongue 18 that is integral with a dual slot slide that comprises a pair of mutually parallel slot openings 19 and 21, the long dimension of which is perpendicular to the longitudinal axis of the tongue. The female end 15 of each buckle comprises an opening 22 sized and dimensioned to receive the tongue 18 and containing a releasable locking device to maintain the tongue 18 within the opening 22, all constructed in a manner well known to the buckle art. Disposed on the end of the female portion of the buckle that is opposite the opening 22 is a single cross slot 23, arranged to receive the webbing 5 near its terminal end. In the preferred form of the sling, the end of the webbing is laced through the opening 23, around adjoining transverse loop bar 24 and folded back and fastened to itself by sewing 25 or other means that will secure the webbing to the female portion of the buckle. For example, the webbing may be secured to the bar 24 by sewing the webbing together at a point 25 adjacent the transverse loop bar. Following the point of attachment to the buckle bar 24, the webbing is extended for a short distance, for example, two to three inches, beyond the sewing connection 25, in order to form a small attaching loop 30. The loop 30 is formed by folding the short extended end of the webbing back on itself and interconnecting the folded portions with a releasable attachment, such as a pair of threaded screws and posts 32. The loop 30 provides the means for attaching the end of the sling 2 to a ring 24 on a gun 36 or other article, as shown in FIGS. 7, 8 and 18. Both the first and second terminal ends of the webbing 5 are similarly constructed in order to provide two connecting points, or terminal means, to the gun or other article being carried by the strap 2.

Figure 19:
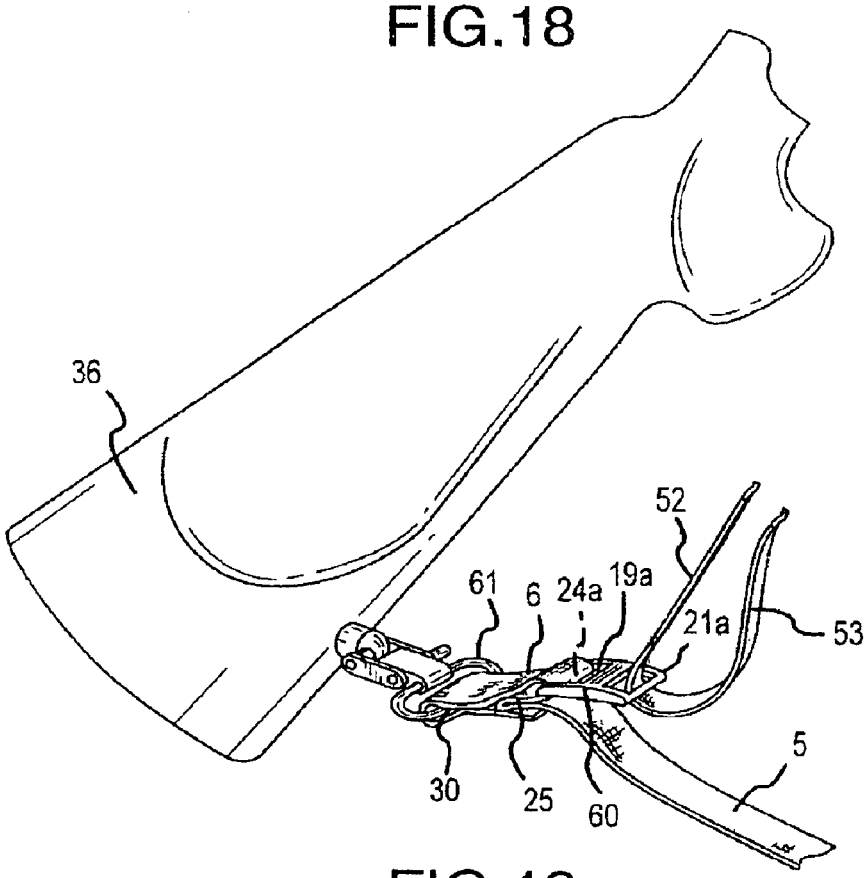
FIG. 19 is a perspective-fragmentary view of the attachment of one end of the sling to an eye-screw protruding from the butt of a rifle. The Figure also illustrates an alternative embodiment of one terminating end of the sling where the detachable buckle shown in FIG. 18 has been eliminated.

As shown in FIG. 19, the sling may be constructed at its terminal ends without releasable buckles. A single-bar slide 60, having parallel slot openings 19*a* and 21*a* on either side of its central cross bar, is attached by sewing or other means to secure the end 6 of the strap around the end transverse bar 24*a* of the slide 60. The slot openings 19*a* and 21*a* of the single-bar slide 60 accomplishes the same function as the parallel slot openings 19 and 21 that are part of the male portion of the releasable buckles 7 and 9. Terminal means, such as a gun-connecting swivel 61, or other form of connection may be secured to the terminal end of the strap for making an attachment to the object to be carried by the sling. The absence of releasable buckles at one or both of the ends of the sling limit the number of carrying and ready-position configurations shown by the examples of FIGS. 7–17. However, using single bar slides 60 instead of buckles 7 or 9 and the ladder rungs that define the perimeters of the slots 19 and 21 of the releasable buckles 7 and 9 still accomplishes many of the various carrying positions of the basic sling.

Figure 2:
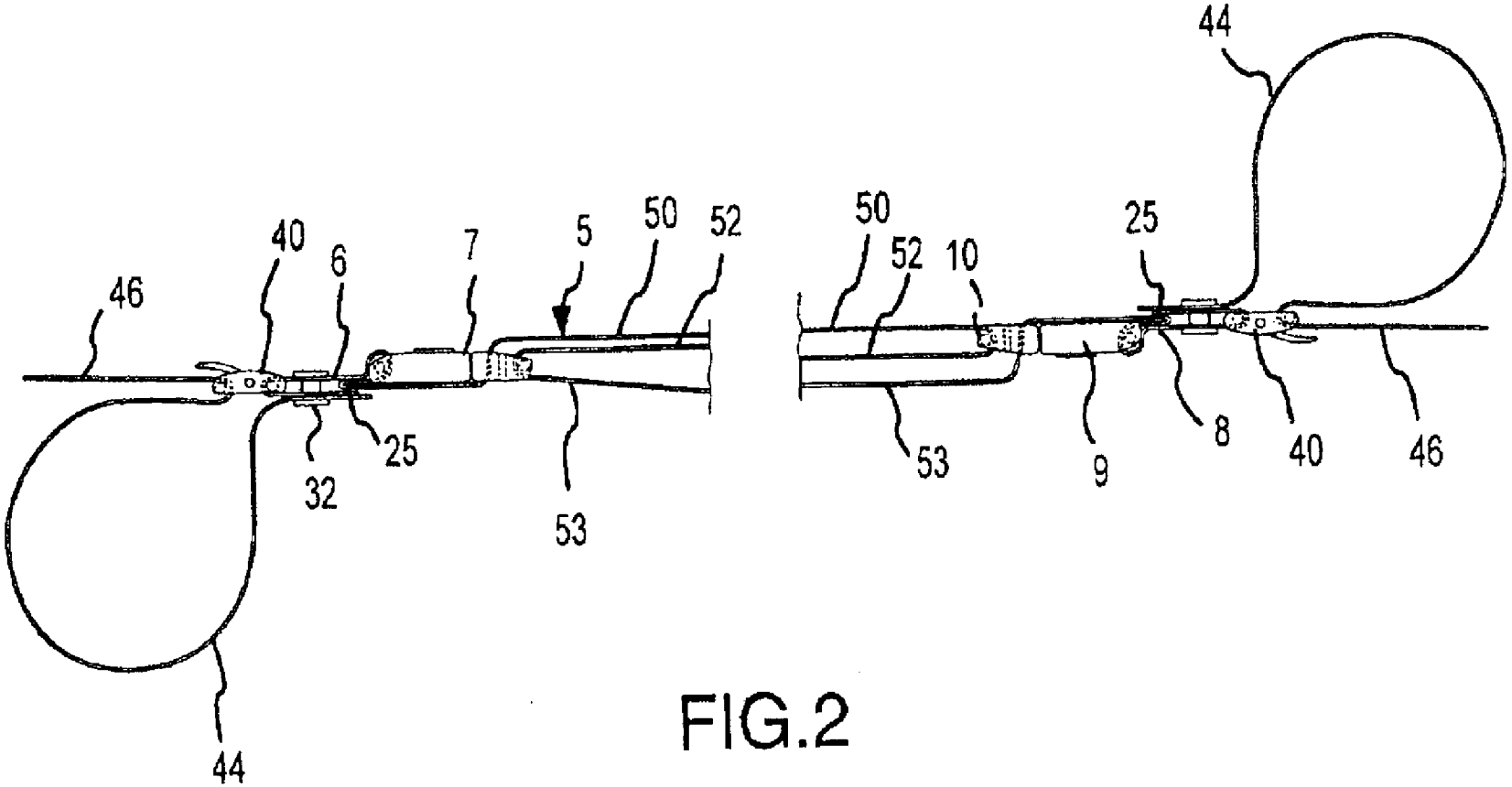
FIG. 2 is a side view of the carrying strap of the present invention with added straps for carrying an archery bow.

For attachment to archery bows, skis or other articles not having connecting rings or eye screws, the terminal means may include an extension strap 44 that is formed into a loop to encircle the object to be carried, such as the limb of an archery bow or the body of a pair of skis. To implement this alternative form of the sling, a cam buckle 40 is secured to the loop 30 by lacing the short extended end 6 of the webbing 5 around the loop bar 41 of the cam buckle 40, as shown in FIGS. 5 and 6. Under the buckle 40 the separate elongated extension strap 44 is secured to the end 6 of the webbing 5 by the same threaded screw and post fasteners 32 that form the loop 30, as seen in FIGS. 2, 5 and 6. The free end 46 of the elongated attachment strap 44 is wrapped around or otherwise secured to the bow or other object to be carried, and then inserted into the locking slot of the cam buckle 40. The end 46 of the attachment strap is secured by the latching mechanism of the cam buckle to create a fixed loop that encircles a portion of the object to be carried. By means of the cam buckle 40 the loop formed by the elongated strap may be pulled tightly around the object prior to locking the strap in place with the cam buckle.

Figure 1:
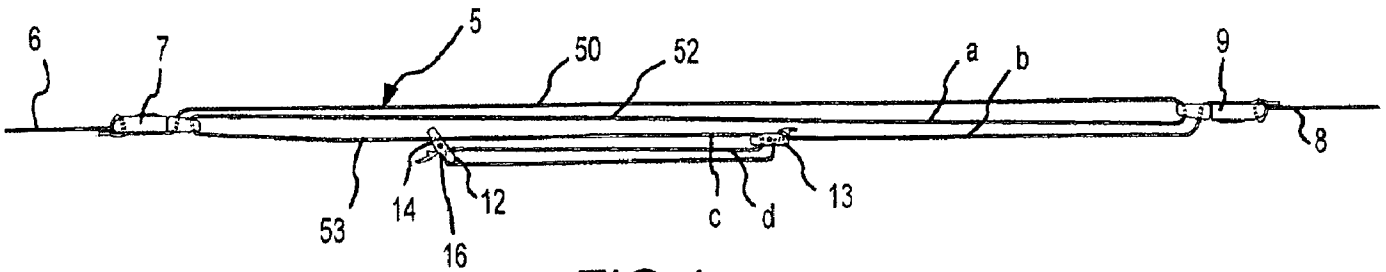
FIG. 1 is a side view of the carrying strap of the present invention configured especially for long barreled guns.
Figure 4:
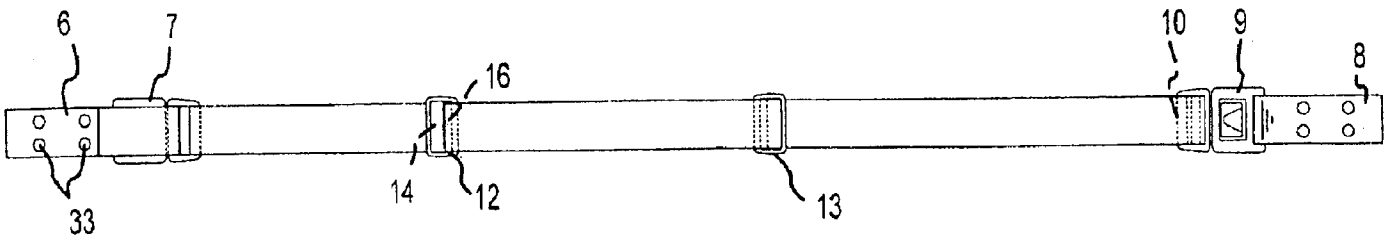
FIG. 4 is a bottom view of the strap shown in FIG. 1.

The terminating buckles 7 and 9 are each similarly interconnected to the respective terminal ends 6 and 8 of the webbing 5 except that the first buckle 7 is oriented with its "topside" facing upward while the "topside" of the second (right hand) buckle 9 faces downwardly. This orientation allows the formation of the top loop a. As seen in FIG. 1, the first end of the webbing 5 runs from its point of loop bar attachment 25 underneath the buckle 7 and is then laced through the interior one 19 of the pair of mutually parallel slots in the male member 17 of the first buckle 7. A length or reach 50 of the webbing 5 extends from the slot 19 to the second buckle 9 where, at the end of the reach the webbing is trained around an end-forming loop bar 10 in the male half 17 of the second buckle. Following its free travel lacing around the loop bar 10, the webbing 5 is folded back on itself to extend into a second reach 52, forming the bottom part of the top loop a. At the end of the second reach 52 the webbing is trained around the end-forming loop bar 11 in the male section 17 of the first release buckle 7. Following its free travel training around the loop bar 11, the webbing 5 is again folded back on itself to extend into a third reach 53, forming the bottom part of the next loop b.

The third reach 53 of the webbing 5 extends to the terminating release buckle 9 where the end 8 of the webbing is secured to the buckle 9 as previously described. However, intermediate the fold of the webbing around the first release buckle's loop bar (or ladder rung) 11 and the webbing termination point at the second release buckle 9 two additional adjustment loops c and d are formed with the aid of cam release buckles 12 and 13.

Each of the cam release buckles 12 and 13 have a web-receiving slot opening 14 where the web is lockable in its position with respect to the buckle by means of a cam lever, similar to cam buckle 40, already described. That is, when the lever is moved into locking position, the webbing in the receiving slot 14 is locked or secured in place and cannot be moved relative to the buckle. The opening 14 that functions with the lever to lock the webbing in place is herein referred to as the "locking slot." Each of the cam buckles also contains a second web-receiving slot 16 that allows the webbing to freely move within the slot at all times. This slot 16 is referred to as the "slidable slot."

In order to form the loops c and d, the webbing 5 that comprises the third reach 53 is directed through the locking slot of the first cam buckle 12 and then through the slidable slot in the second cam buckle 13. The webbing 5 is folded back upon itself around the end bar of the second cam buckle 13 to form the loop c and then directed into the slidable slot of the first cam buckle 12 where the webbing is again folded back on itself and directed through the locking slot of the second cam buckle 13 to form the loop d. By reference to FIG. 1 it can be seen that the reaches of webbing that form the loops c and d can be lengthened or shortened by changing the position of the cam buckles 12 and 13 on the reach 53 of the sling 2. In operation, spreading the cam buckles 12 and 13 apart will increase the reach of that part of the webbing forming the loops c and d with the consequent shortening of the reach 53, that is, the distance between the first and second release buckles 7 and 9. Alternatively, adjusting the position of the cam buckles 12 and 13 on the reach 53 so that the cam buckles are close together will shorten the reach of the webbing that forms loops c and d, thus increasing the length of the reach 53, that is, the distance between the first and second release buckles 7 and 9.

While a preferred form of mechanism for adjusting the length of the third reach has been described, other devices for varying the length of the third or even the first and second reaches, may be used to accomplish the purposes and objects of the present invention. In fact, if the sling is designed and constructed for a particular person or for a few specific uses, the length adjustment of one of the reaches may be eliminated entirely.

The construction of the sling 2, as just described for the preferred form, provides several advantages that have been absent from prior art carrying slings. First, the adjustment loops c and d make it possible to vary the overall length of the sling and adjust its size to the person using it or to the clothing being worn by that person. Second, the three primary reaches of webbing 50, 52 and 53 offer a multitude of choices as to how the sling will be worn on the body of the user. Third, choosing between having the terminating release buckles 7 and 9 in the buckled or unbuckled position adds even further versatility to the sling.

FIGS. 7–17 illustrate exemplary ways in which the sling 2 may be utilized by judicious choices of adjustment, buckle configuration and various modes of wearing the sling.

Figure 9:
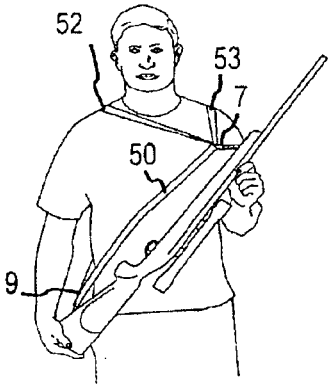

FIG. 7 illustrates the position and configuration of the sling 2 when a person is using the sling to carry a rifle in a front and ready position with the straps, or reaches, 52 and 53 being both positioned over one shoulder. An alternative form of this carry is shown in FIG. 9 where the reaches 52 and 53 are split and positioned over both shoulders to equalize the carrying load. Other than the position of the straps 52 and 53 on the shoulders of the user, the actual configuration of the sling for this carrying mode is the same, whether used over one or two shoulders. The end buckles 7 and 9 are both in the "connected" position, that is, the male and female portions are engaged. The top reach 50 of the sling is disposed from one shoulder diagonally across the chest and down to the connection with the gun butt that is positioned over the hip of the person carrying. If needed, the length adjusting cam buckles 12 and 13 on the reach 53 can be adjusted to provide the proper length for the straps 52 and 53 to fit the particular user.

An arrangement somewhat similar to that of FIGS. 7 and 9 is shown in FIG. 8 where the gun is worn on the back of the user. In this configuration straps 50 and 52 are both worn over one shoulder while the bottom reach strap 53 is worn over the opposite shoulder.

Figure 10:
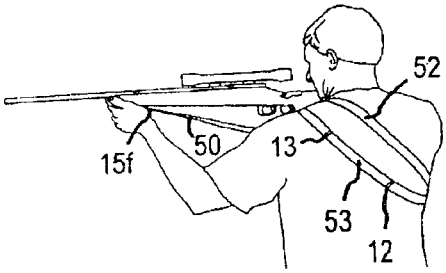
Figure 11:
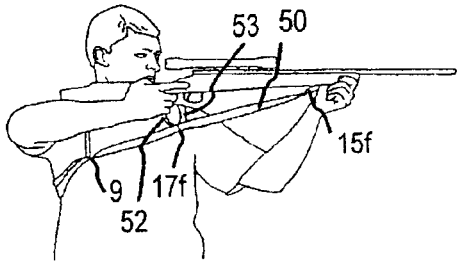

FIGS. 10 and 11 demonstrate how the gun is quickly changed from the ready position of FIG. 7 to a shooting position. The first end buckle 7 that is attached to the barrel end of the gun 36 is released, allowing the top strap 50 to elongate or extend. FIGS. 10 and 11 show the female end 15*f* of the first end buckle 7 still proximate the rifle barrel, while the male portion 17*f* of the buckle 7 is drawn back toward the body of the user, allowing the straps 53 and 52 to freely thread through the loops of the male portion. Buckle 9 on the second end of the strap is still connected, that is, the male and female portions are engaged.

Figure 12:
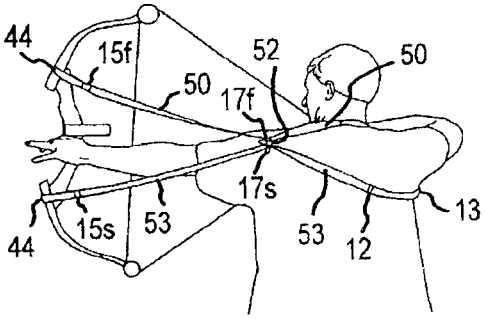

FIG. 12 depicts the sling 2 in use while attached to an archery bow in the shooting position. The extension straps 44 at each of the first and second ends of the sling are wrapped around the arms of the bow and secured as described earlier in the description of this invention. The first and second end buckles 7 and 9 are both released with the female portions 15*f* and 15*s* of those buckles remaining near the extension straps 44. The top strap, or reach, 50 and the bottom strap 53 converge to the male portions 17*f* and 17*s* of the buckles 7 and 9 where the straps have been threaded through the loops of the male ends so that the second strap 52 is severely shortened. The top strap 50 and the third strap 53 of the sling continue through the loops of the male portions 17*f* and 17*s* to wrap around the back and under the arm of the user.

Figure 13:
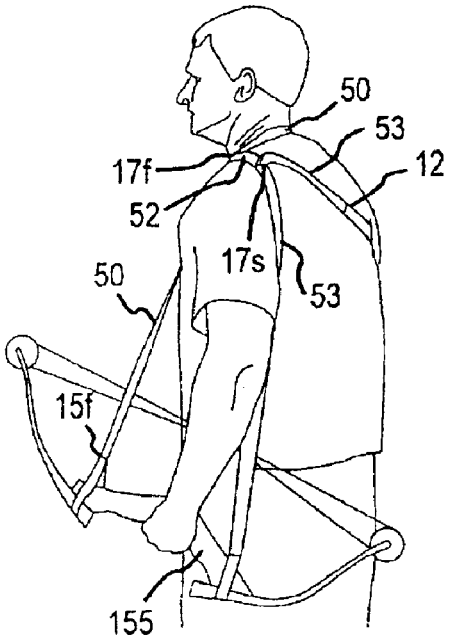

FIG. 13 illustrates the same sling configuration as shown in FIG. 12, except the bow is being carried in the ready position. This view shows how the weight of the bow is actually supported on the left shoulder of the user and carried by the straps 50, 52 and 53. The extension of straps 50 and 53 over the back and under the right arm of the user keeps the sling from falling off of the left shoulder but permits a quick change to the shooting position of FIG. 12, without any hindrance.

Figure 14:
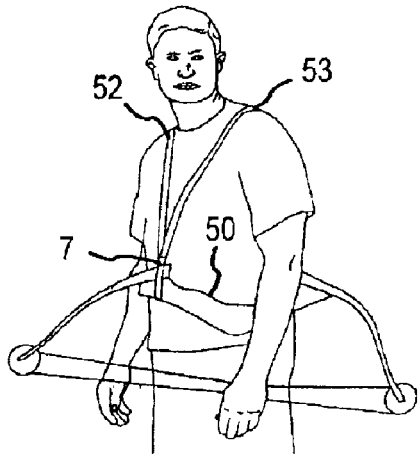

FIG. 14 depicts a two-shoulder side carry of an archery bow. This is a long transport carry where buckles 7 and 9 (9 is not visible behind the left arm of the user) are connected and are not released. In this position the bow is not immediately ready for shooting.

Figure 15:
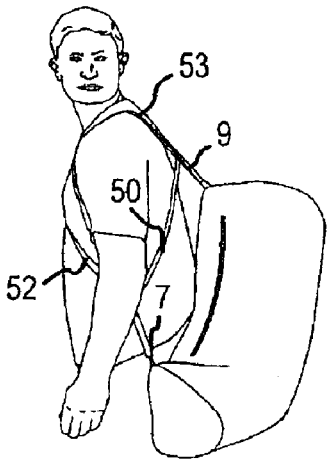

FIG. 15 demonstrates the sling 2 being employed to carry a duffle bag in a manner similar to the back carry of the rifle in FIG. 8. The buckles 7 and 9 are both connected and the second and third straps 52 and 53 are split over the two shoulders of the user.

Figure 16:
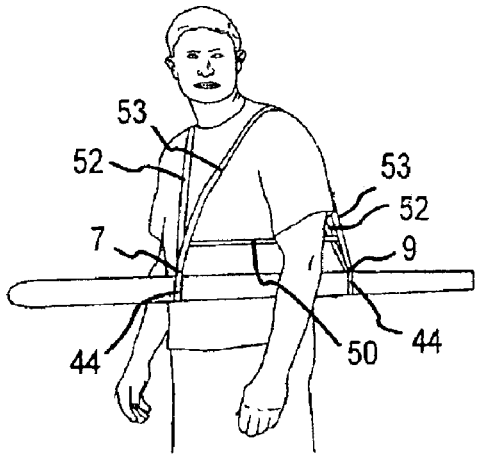
Figure 17:
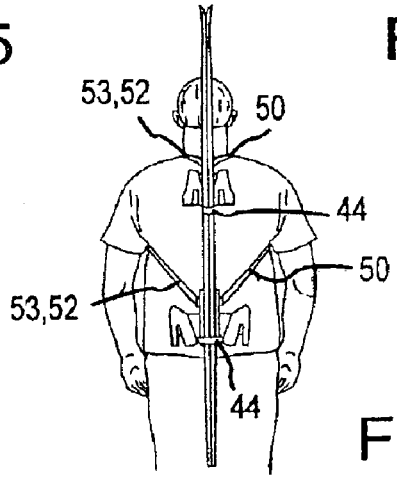

The sling 2 can easily carry skis, as shown in FIGS. 16 and 17. Similar to the side carry of an archery bow, shown in FIG. 14, skis are attached to the sling with the extension straps 44 at each end of the sling. For longer distances or climbing, the skis may be positioned vertically on the back of the user, as shown in FIG. 17. In this configuration the straps 52 and 53 are placed in juxtaposition over the left shoulder of the user while the top strap 50 is positioned over the right shoulder. Both the left and right shoulder strap elements go over the shoulders and under the arms to secure the skis in fixed position on the back.

While not mentioned for each of the above configurations, it is understood that the adjusting cam buckles can be used to adjust the various lengths of the sling reaches in order to accommodate the particular carrying or action position of the article attached to the sling and to the size of the user. Of course the adjustment buckles could be eliminated without degrading the usefulness of the sling or the concepts of the releasable end buckles if adjustment of the size was deemed unnecessary for a particular use or user. Similarly, the end buckles could have different configurations or perhaps be eliminated if certain functions or possible configurations of the sling were also eliminated.

It should be pointed out that the sling 2 of the present invention has a number of configurations and possible uses that are not illustrated. The illustrations are not intended to be limiting in any way, but instead are intended to be illustrative of a sampling of the ways in which the sling 2 may be used and configured.

I claim:

1. A carrying sling comprising, a strap having first and second ends and being twice folded back on itself to form first, second and third reaches between the first and second ends, first terminal means attached to the first end of the strap, second terminal means attached to the second end of the strap, first and second slides slidably carrying the strap at each of the two folds therein, first and second attachment means for interconnecting the first and second slides with the first and second terminal means respectively; and length adjustment means carried by the third reach for selectively varying the length of the third reach.

2. The carrying sling of claim 1 where the length adjustment means comprises two cam lock buckles each having dual parallel openings through both of which the third reach of the strap is trained.

3. The carrying sling of claim 2 where the cam lock buckles each comprise, a single-bar slide having a clamping lever pivotally carried by the bar to selectively lock the third reach of the strap in a fixed position within one of the said dual parallel openings.

4. The carrying sling of claim 3 where the third reach is twice folded back upon itself to form first, second and third sub lengths of the third reach and where the location at which the strap is trained through one of the parallel openings in the second cam buckle defines the fold between the first and second sub-lengths of the strap and where the location at which the strap is trained through one of the parallel openings in the first cam buckle defines the fold between the second and third sub-lengths of the strap.

5. The carrying sling of claim 1 and further comprising, first and second flexible extension straps attached respectively to the first and second terminal means, means attached to each of the terminal means for creating a loop in the extension strap that wraps around an object for securing it to each of the terminal means.

6. The carrying strap of claim 1 where the first and second terminal ends each include attachment means for interconnecting the said first and second terminal ends to an object to be carried.

7. A carrying sling comprising, a strap having first and second terminal ends and being twice folded back on itself to form first, second and third reaches between the first and second ends, a first tri-glide having parallel proximal and distal openings, the first reach being trained through the proximal opening and the second reach being trained through the distal opening and forming a second fold in the strap, a second tri-glide having parallel proximal and distal openings, the third reach being trained through the proximal opening and the first reach being trained through the distal opening and forming a first fold in the strap, first and second connecting means for interconnecting the first and second terminal ends with the first and second tri-glides respectively.

8. The carrying sling of claim 7 where at least one of the first and second connecting means is releasable.

9. The carrying sling of claim 8 and further including, anti-slip adjusting means carried by one reach of the strap for selectively adjusting the effective length of the said one reach.

10. The carrying sling of claim 9 where the anti-slip adjusting means comprises, first and second sliding clamps, each having parallel dual openings and an attached pivotal clamping lever to secure a strap in a fixed position within one of the said parallel openings, a length of the said one reach twice folded back upon itself to form first, second and third sub lengths of the said one reach, where the fold between the first and second sub-lengths of is defined by the strap being trained through one of the parallel openings in the second sliding clamp and where the fold between the second and third sub-lengths is defined by the strap being trained through one of the parallel openings in the first sliding clamp.

11. A carrying sling comprising, a strap having first and second terminal ends and being twice folded back on itself to form first, second and third reaches between the first and second ends, attachment means for interconnecting the said first and second terminal ends to an object to be carried, a first tri-glide having parallel proximal and distal openings, the first reach being trained through the proximal opening and the second reach being trained through the distal opening and forming a second fold in the strap, a second tri-glide having parallel proximal and distal openings, the third reach being trained through the proximal opening and the first reach being trained through the distal opening and forming a first fold in the strap, first and second connecting means for interconnecting the first and second terminal ends with the first and second tri-glides respectively, at least one of said first and second connecting means being releasable, and anti-slip adjusting means carried by one reach of the strap for selectively adjusting the length of the said one reach between the first and second terminal ends.

* * * * *